US011247351B2

(12) United States Patent
Winters et al.

(10) Patent No.: US 11,247,351 B2
(45) Date of Patent: Feb. 15, 2022

(54) ROTARY SHAVER COMPRISING A DISC-SHAPED ELEMENT

(71) Applicant: KONINKLIJKE PHILIPS N.V., Eindhoven (NL)

(72) Inventors: Josty Winters, Eindhoven (NL); Ingmar Grasmeijer, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 425 days.

(21) Appl. No.: 14/772,836

(22) PCT Filed: Feb. 10, 2015

(86) PCT No.: PCT/EP2015/052672
§ 371 (c)(1),
(2) Date: Sep. 4, 2015

(87) PCT Pub. No.: WO2015/124456
PCT Pub. Date: Aug. 27, 2015

(65) Prior Publication Data

US 2016/0297084 A1 Oct. 13, 2016

(30) Foreign Application Priority Data

Feb. 24, 2014 (EP) ..... 14156308

(51) Int. Cl.
*B26B 19/14* (2006.01)
*B26B 19/38* (2006.01)

(52) U.S. Cl.
CPC ..... *B26B 19/143* (2013.01); *B26B 19/3853* (2013.01)

(58) Field of Classification Search
CPC ..... B26B 19/14; B26B 19/143; B26B 19/145; B26B 19/146; B26B 19/148
See application file for complete search history.

(56) References Cited

U.S. PATENT DOCUMENTS 2,331,417 A * 10/1943 Naegeli ..... B26B 21/00 30/145
5,797,714 A * 8/1998 Oddenino ..... B60R 13/0206 411/508

(Continued)

FOREIGN PATENT DOCUMENTS

DE 7829254 U1 2/1979
DE 10111939 A1 11/2002

(Continued)

OTHER PUBLICATIONS

"Corrosion Control By Design" 2014, Available At: http://www.uobabylon.edu.iq/eprints/publication_12_18403_228.pdf.

(Continued)

*Primary Examiner* — Jason Daniel Prone
*Assistant Examiner* — Samuel A Davies

(57) ABSTRACT

A rotary shaver (1) comprising a metal external cutting element (7) and a disc-shaped element (10) having a central axis (12). The disc-shaped element covers at least part of the external cutting element. The disc-shaped element is in contact with the external cutting element by means of a raised ring-shaped rim (15) extending between a side surface of the external cutting element and a side surface of the disc-shaped element, which raised ring-shaped rim has a height of at least 0.1 millimetre in a direction parallel to the central axis and a width of less than 0.35 millimetre in a direction radial to the central axis.

14 Claims, 7 Drawing Sheets

(56) References Cited

U.S. PATENT DOCUMENTS

| | | | | |
|---|---|---|---|---|
| 7,356,929 | B2 * | 4/2008 | Nakano | B26B 19/141 30/346.51 |
| 8,255,355 | B2 | 8/2012 | D'Alo et al. | |
| 2004/0163258 | A1 * | 8/2004 | Uchiyama | B26B 19/14 30/43.2 |
| 2008/0194914 | A1 | 8/2008 | Iwasaki | |
| 2009/0320294 | A1 * | 12/2009 | Shimizu | B26B 19/14 30/43.6 |
| 2010/0132749 | A1 | 6/2010 | Büehlmeyer | |
| 2010/0139098 | A1 * | 6/2010 | Kuijper | B26B 19/143 30/45 |

FOREIGN PATENT DOCUMENTS

| | | | |
|---|---|---|---|
| EP | 1375089 | A1 | 1/2004 |
| EP | 1690654 | A1 | 8/2006 |
| GB | 2046392 | A | 11/1980 |
| JP | 2003307583 | A | 10/2003 |
| JP | 2011064397 | A | 3/2011 |
| WO | 2006067713 | A1 | 6/2006 |

OTHER PUBLICATIONS

"Principles and Prevention of Crevice Corrosion" 2014, Available At: http://www.bssa.org.uk/topics.php?article=116.

* cited by examiner

ROTARY SHAVER COMPRISING A DISC-SHAPED ELEMENT

This application is the U.S. National Phase application under 35 U.S.C. § 371 of International Application No. PCT/EP2015/052672, filed on Feb. 10, 2015, which claims the benefit of European Application No. 14156308.0 filed on Feb. 24, 2014. These applications are hereby incorporated by reference herein.

FIELD OF THE INVENTION

The invention relates to a rotary shaver comprising a metal external cutting element, an internal cutting element being rotatable with respect to the external cutting element about an axis of rotation, and a disc-shaped element having a central axis extending coaxially with the axis of rotation, which disc-shaped element covers at least part of the external cutting element.

BACKGROUND OF THE INVENTION

Such rotary shavers are known, wherein part of a metal external cutting element is hidden from view by a disc-shaped cap to improve the appearance of the rotary shaver. The disc-shaped cap is provided on the metal external cutting element, whereby openings and/or apertures in the metal external cutting element are hidden from view by the disc-shaped cap, and a nice appearance is obtained. When there is a relatively small crevice between the metal external cutting element and the cap, transport between acid and base places in the crevice is relatively hard or even impossible because no air, water etc. can flow in the crevice, so that the environment between the disc-shaped cap and the metal external cutting element becomes more aggressive and crevice corrosion will occur.

DE 78 29 254 U1 discloses a covering member for a screw. The covering member comprises centrally arranged snap elements by means of which the covering member can be connected to a central cross-shaped opening in the head of the screw. A side surface of the covering member facing the screw is provided with a rim around its circumference.

DE 101 11 939 discloses a covering member for a screw. This covering member comprises a centrally arranged pen by means of which the covering member can be connected to a central cross-shaped opening in the head of the screw.

EP 1 375 089 A1 discloses an electric shaver comprising front and rear housing portions which are mutually connected by means of screws provided with screw covers.

SUMMARY OF THE INVENTION

In view of the above, a general object of the present invention is to provide a rotary shaver wherein a disc-shaped element is used to improve the appearance of the external cutting element, and wherein crevice corrosion between the disc-shaped element and the external cutting element is avoided.

According to a first aspect, the invention provides a rotary shaver of the type mentioned in the opening paragraph, wherein the disc-shaped element is in contact with the external cutting element by means of a raised ring-shaped rim extending between a side surface of the external cutting element facing the disc-shaped element and a side surface of the disc-shaped element facing the external cutting element, which raised ring-shaped rim has a height of at least 0.1 millimetre in a direction parallel to the central axis and a width of less than 0.35 millimetre in a direction radial to the central axis.

Due to the rim between the disc-shaped element and the external cutting element, said elements are located at a distance from each other which is larger than 0.1 millimetre. With such a distance between the disc-shaped element and the external cutting element no crevice corrosion will occur.

Since the rim itself is less than 0.35 millimetre wide, there will be no crevice corrosion at the rim either.

According to a further aspect, the invention provides a rotary shaver, wherein the ring-shaped rim is a continuous uninterrupted rim.

Although a continuous uninterrupted ring-shaped rim provides a larger contact area between the disc-shaped element and the external cutting element than a ring-shaped rim made up of a number of ring-shaped parts with intermediate spaces, it has been found that such a continuous uninterrupted ring-shaped rim provides better protection against crevice corrosion than the ring-shaped rim comprising a number of ring-shaped parts.

According to a further aspect, the invention provides a rotary shaver, wherein the ring-shaped rim forms part of the disc-shaped element.

Such a ring-shaped rim can easily be made as an integral part of the disc-shaped element, wherein the raised rim extends towards the external cutting element.

According to a further aspect, the invention provides a rotary shaver, wherein the disc-shaped element comprises a disc-shaped covering member, and wherein the ring-shaped rim extends along a circumference of the disc-shaped covering member on a side surface of the disc-shaped covering member facing the external cutting element.

The disc-shaped covering member covers at least part of the external cutting element, wherein by means of the ring-shaped rim crevice corrosion between the disc-shaped covering member and the external cutting element is prevented.

According to a further aspect, the invention provides a rotary shaver, wherein the ring-shaped rim forms part of the external cutting element.

Such a ring-shaped rim can easily be made as an integral part of the external cutting element, wherein the raised rim extends towards the disc-shaped element.

According to a further aspect, the invention provides a rotary shaver, wherein the ring-shaped rim encloses a gap which is present between the external cutting element and the disc-shaped element and which has a gap height equal to or greater than the height of the ring-shaped rim.

Since the gap has a gap height equal to or greater than the height of the ring-shaped rim, crevice corrosion between the disc-shaped element and the external cutting element is prevented.

According to a further aspect, the invention provides a rotary shaver, wherein the disc-shaped element is made of plastic.

Such a disc-shaped element can easily be made by injection moulding, wherein the ring-shaped rim can be formed during the injection moulding process as an integral part of the disc-shaped element.

According to a further aspect, the invention provides a rotary shaver, wherein the disc-shaped element and the external cutting element are connected to each other by means of a glue provided on the ring-shaped rim.

Glue provides an easy manner to connect the disc-shaped element and the external cutting element to each other. Here, the ring-shaped rim is used to prevent crevice corrosion and to provide a well defined area for applying the glue.

According to a further aspect, the invention provides a rotary shaver, wherein the external cutting element is provided with a passage, whilst the disc-shaped element is provided with a pen having a length, wherein the pen is press-fitted in the passage, and wherein between a wall of the passage and the pen at least one vent extends at least along the length of the pen.

By connecting the disc-shaped element to the external cutting element, the pen of the disc-shaped element is inserted and pushed into the passage of the external cutting element, whereby a press-fit is obtained due to which the disc-shaped element is firmly connected to the external cutting element. To detach the disc-shaped element from the external cutting element, a force needs to be applied on the disc-shaped element in order to pull the pen out of the passage. In the case of such a connection, no glue is needed.

During use of the rotary shaver, the disc-shaped element and the external cutting element might heat up. During this heating up, air in the passage near an end of the pen will expand. To avoid that due to the expanded air the pen will be pushed out of the passage, at least one vent extends at least along the length of the pen. Through the at least one vent, air can flow to relief the air pressure in the passage. By virtue of the at least one vent, the press-fit connection between the disc-shaped element and the external cutting element is maintained, also when the disc-shaped element and the external cutting element are heated up.

BRIEF DESCRIPTION OF THE DRAWINGS

The rotary shaver according to the invention will be further explained with reference to the drawings, wherein.

In the drawings, like reference numerals refer to like elements.

DESCRIPTION OF PREFERRED EMBODIMENTS

Figure 2:
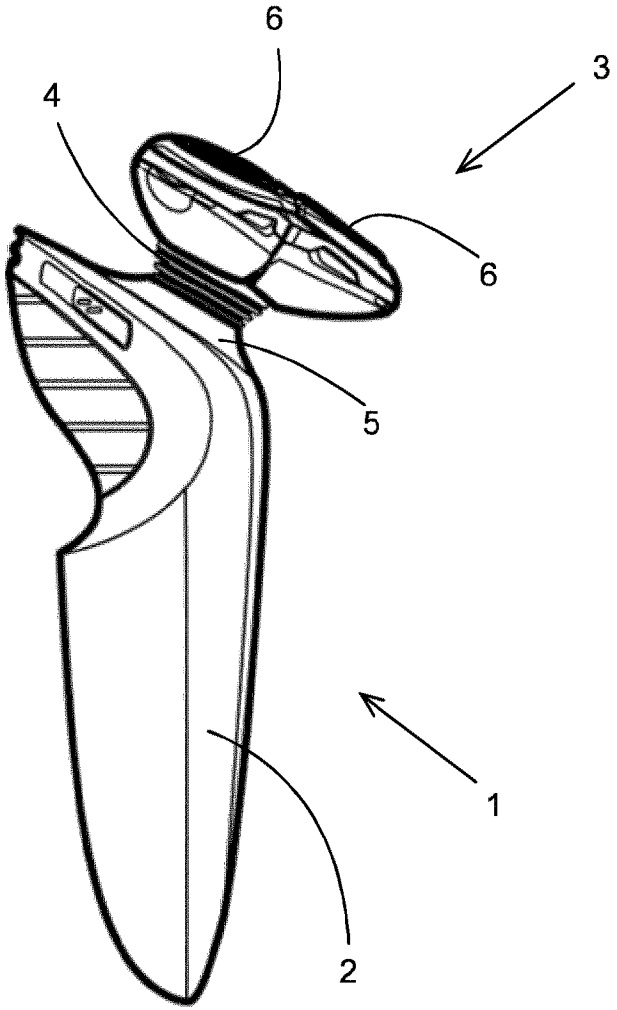
FIG. 2 is a side view of the rotary shaver as shown in FIG. 1.
Figure 1:
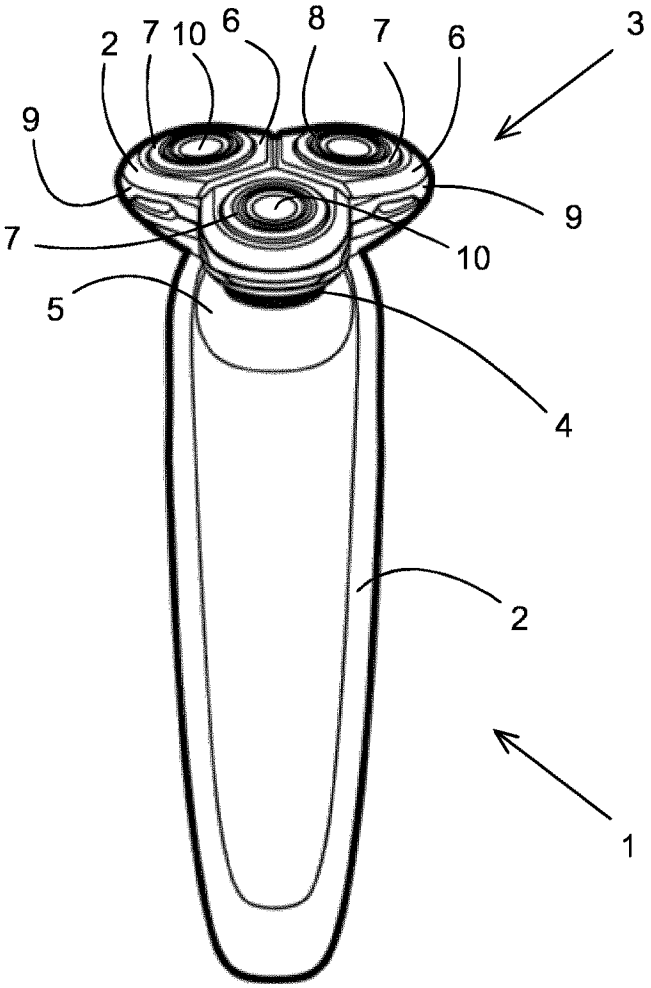
FIG. 1 is a perspective schematic view of a rotary shaver according to the invention.

FIGS. 1 and 2 show a rotary shaver 1 according to the invention. The shaver 1 as shown in FIGS. 1 and 2 comprises a main housing 2, which is suitable to be held by a user of the shaver. The shaver 1 further comprises a hair-cutting module 3, which is suitable to contact an area of skin having hairs to be shaved off and which can suitably be moved with respect to this area. The hair-cutting module 3 is connected to the main housing 2 through a central shaft member 4, wherein the connection of the hair-cutting module 3 to the main housing 2 may be detachable. Cross-sectional dimensions of the central shaft member 4 are considerably smaller than the cross-sectional dimensions of the hair-cutting module 3, and the hair-cutting module 3 is positioned at a certain distance from a top portion 5 of the main housing 2. Consequently, the connection between the main housing 2 and the hair-cutting module 3 has a slim appearance, wherein the hair-cutting module 3 has an elevated position with respect to the main housing 2. Due to this, when a user performs a shaving action by using the shaver 1, he may have a clear side view of the hair-cutting module 3.

The hair-cutting module 3 comprises three cutting units 6, which are arranged in a triangle formation. Within the scope of the present invention, the number of cutting units 6 may also be two or more than three. For the sake of completeness, it is noted that each of the cutting units 6 may be movably arranged to a certain extent, so as to facilitate each of them in following a contour of an area of skin to be shaved. For example, the cutting units 6 may be pivotable, to a limited extent, with respect to the central shaft member 4. Each cutting unit 6 comprises a metal external cutting element 7 which is arranged at a top side of the cutting unit 6, and which has a plurality of openings 8 for letting through hairs to be shaved off. The metal external cutting element 7 is pivotably connected to a base portion 9 of the cutting unit 6. Right underneath the external cutting element 7, on the inside of the cutting unit 6, a metal internal cutting element 20 is rotatable with respect to the external cutting element 7 about an axis of rotation 21. During operation, a central portion of the internal cutting element 20 is pressed against the metal external cutting element 7 under spring force (not shown).

The internal cutting elements 20 of the cutting unit 6 are driven, via gear wheels (not shown), by a main driving axle (not shown) extending from a motor (not shown) in the main housing 2 through the central shaft member 4 into the hair-cutting module 3.

The shaver 1 described so far is known from WO2011055323A1 and WO200810139A1, in the name of the current applicant.

In the case of the shaver 1 according to the invention, the external cutting elements 7 of the cutting unit 6 are provided with plastic disc-shaped elements or caps 10, which have a decorative function.

Figure 3:
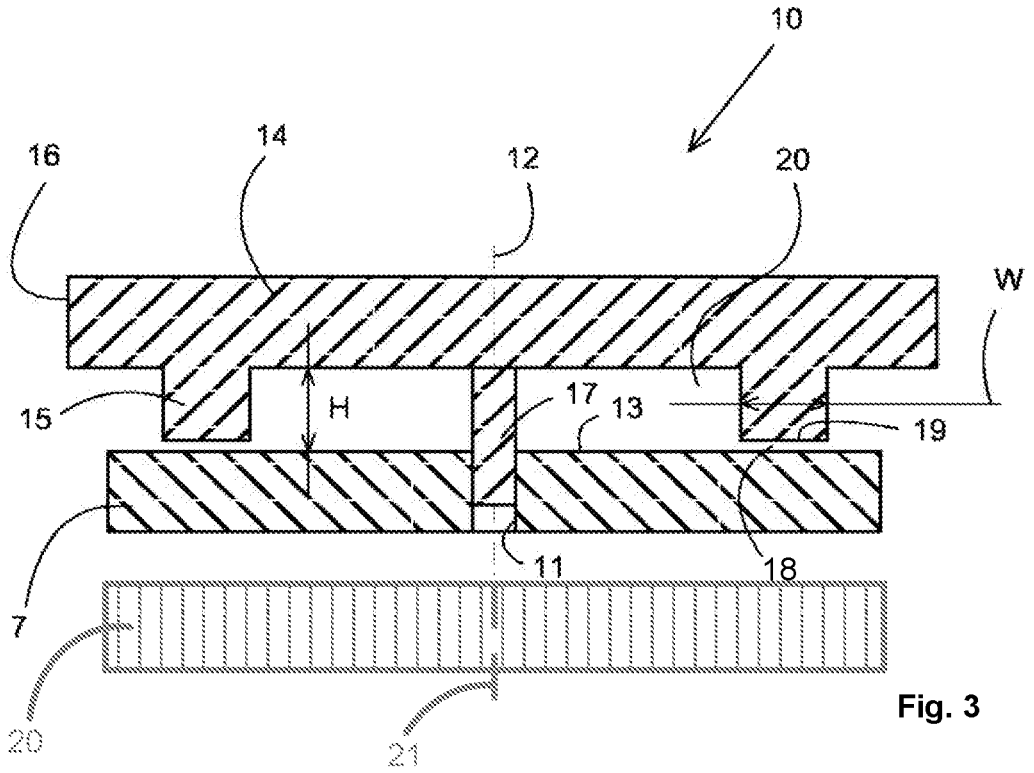
FIG. 3 is a schematic cross section of the rotary shaver as shown in FIG. 1.
Figure 4:
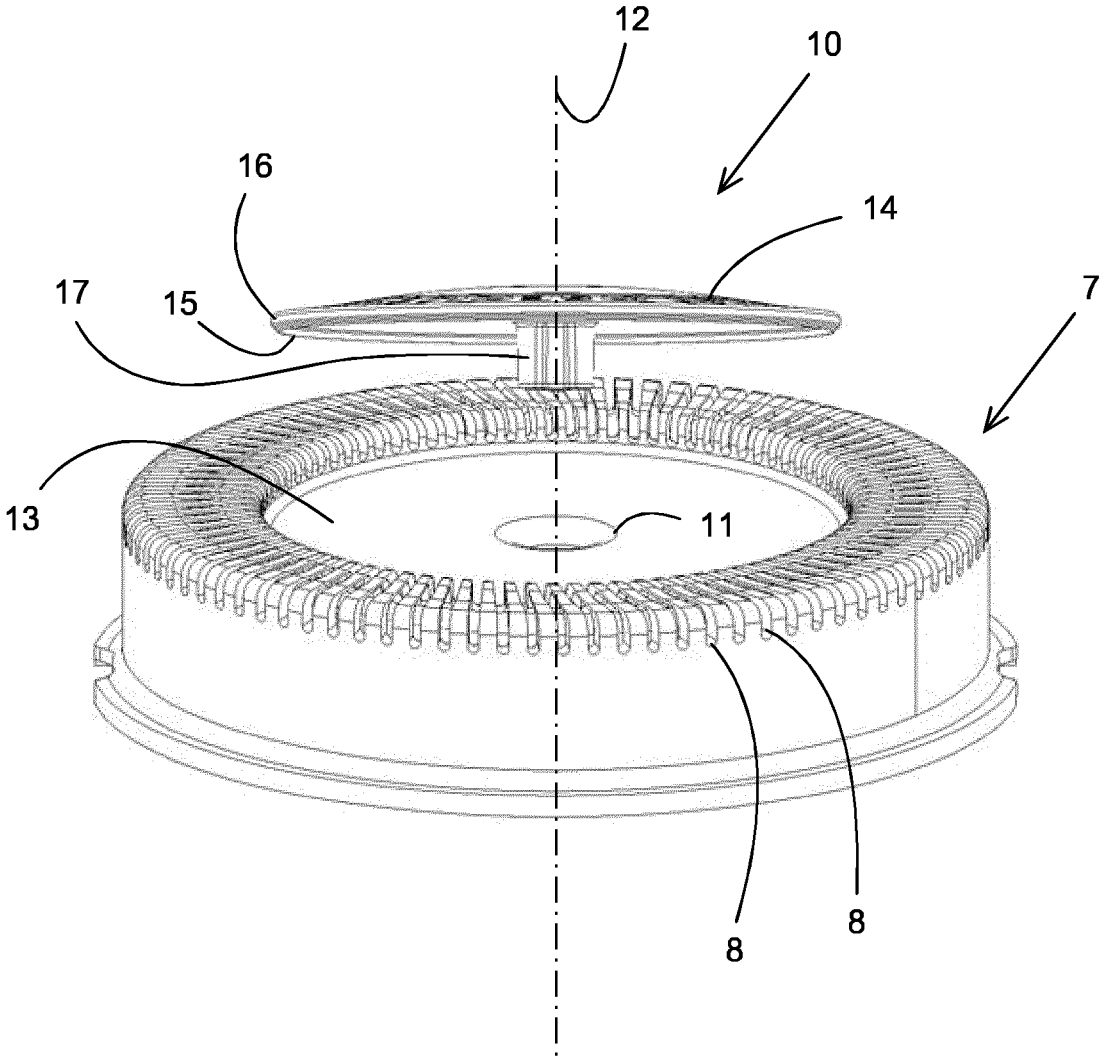
FIG. 4 is a perspective exploded view of an external cutting element and a disc-shaped cap of the rotary shaver as shown in FIG. 1.

FIGS. 3 and 4 are a schematic cross section and a perspective exploded view, respectively, of the shaver 1, showing the metal external cutting element 7 and the plastic disc-shaped cap 10. The external cutting element 7 is provided with a centrally located cylindrical passage 11 extending along an axis 12. The axis 12 is coaxial with an axis of rotation of the internal cutting member. The axis 12 extends perpendicularly to a main external surface 13 of the external cutting element 7. The disc-shaped cap 10 comprises a disc-shaped covering member 14 as well as a continuous uninterrupted (i.e. endless) ring-shaped rim 15 extending symmetrically about the axis 12. The rim 15 is raised relative to a side surface of the disc-shaped cap 10 facing the external cutting element 7 and extends between said side surface of the disc-shaped cap 10 and a side surface of the external cutting element 7 facing the disc-shaped cap 10. In particular, the rim 15 extends from the disc-shaped covering element 14 towards the main external surface 13 of the external cutting element 7. The rim 15 is located near a circumferential edge 16 of the disc-shaped covering member 14 on said side surface of the disc-shaped cap 10, i.e. the rim 15 extends along said circumferential edge 16. The rim 15 has a width W in a direction radial to the axis 12 of less than 0.35 millimetre, preferably as small as possible. The rim 15 has a height H in a direction parallel to the axis 12 of at least 0.1 millimetre. Due to the rim 15, the disc-shaped covering member 14 is kept at a distance H from the main external surface 13 of the external cutting element 7.

Due to the dimensions of the width W of the rim 15 and the distance H between the disc-shaped covering member 14 of the disc-shaped cap 10 and the main external surface 13 of the external cutting element 7, crevice corrosion between the disc-shaped cap 10 and the main external surface 13 of the external cutting element 7 is prevented.

At the axis 12, the disc-shaped cap 10 is provided with a pen 17 extending perpendicularly to the disc-shaped covering member 14. The pen 17 is press-fitted in the passage 11 of the external cutting element 7 to connect the disc-shaped cap 10 to the external cutting element 7. The pen 17 and/or the wall of the passage 11 are provided with grooves or ribs to form vents along the pen 17.

In FIG. 3, a small gap 18 is shown between the external surface 13 of the external cutting element 7 and the external surface 19 of the rim 15. The gap 18 is designed to be 0 millimetre, but in reality there will be a small gap of less than 0.1 millimetre, created due to surface unevenness and flexure of the disc-shaped covering member 14 after the pen 17 has been pressed in. Such a small gap might create crevice corrosion but the effect of the corrosion will be very small because of the endless ring-shaped rim 15.

In FIG. 3, a large gap 20 is shown between the external surface 13 of the external cutting element 7 and the disc-shaped covering member 14. The gap 20 has a gap height which is equal to the height H of the ring-shaped rim 15.

Figure 5:
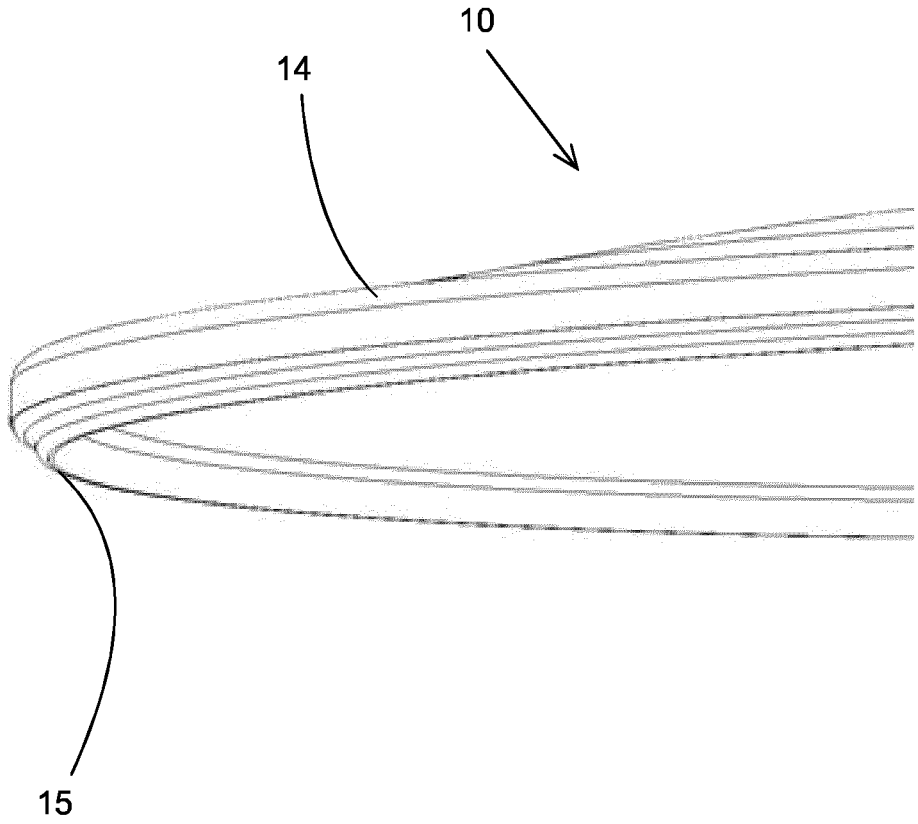
FIG. 5 is a perspective view of a part of a first embodiment of a disc-shaped cap of the rotary shaver as shown in FIG. 1.

FIG. 5 shows a perspective view of a part of the disc-shaped cap 10 of the shaver 1, comprising the disc-shaped covering member 14 and the continuous uninterrupted (endless) ring-shaped rim 15.

Figure 6:
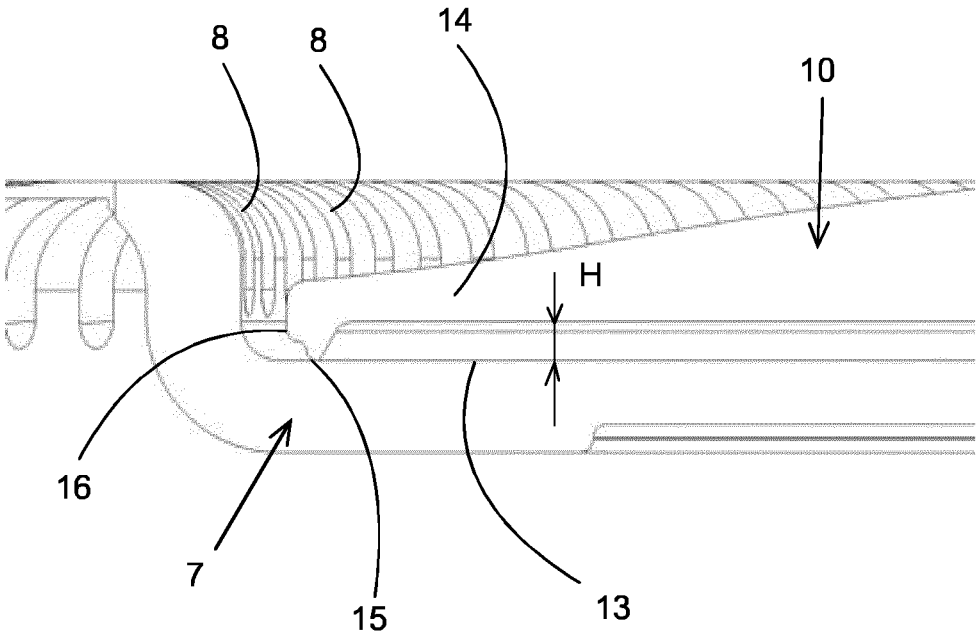
FIG. 6 is an enlarged cross section of the rotary shaver as shown in FIG. 1, comprising the disc-shaped cap as shown in FIG. 4.
Figure 7:
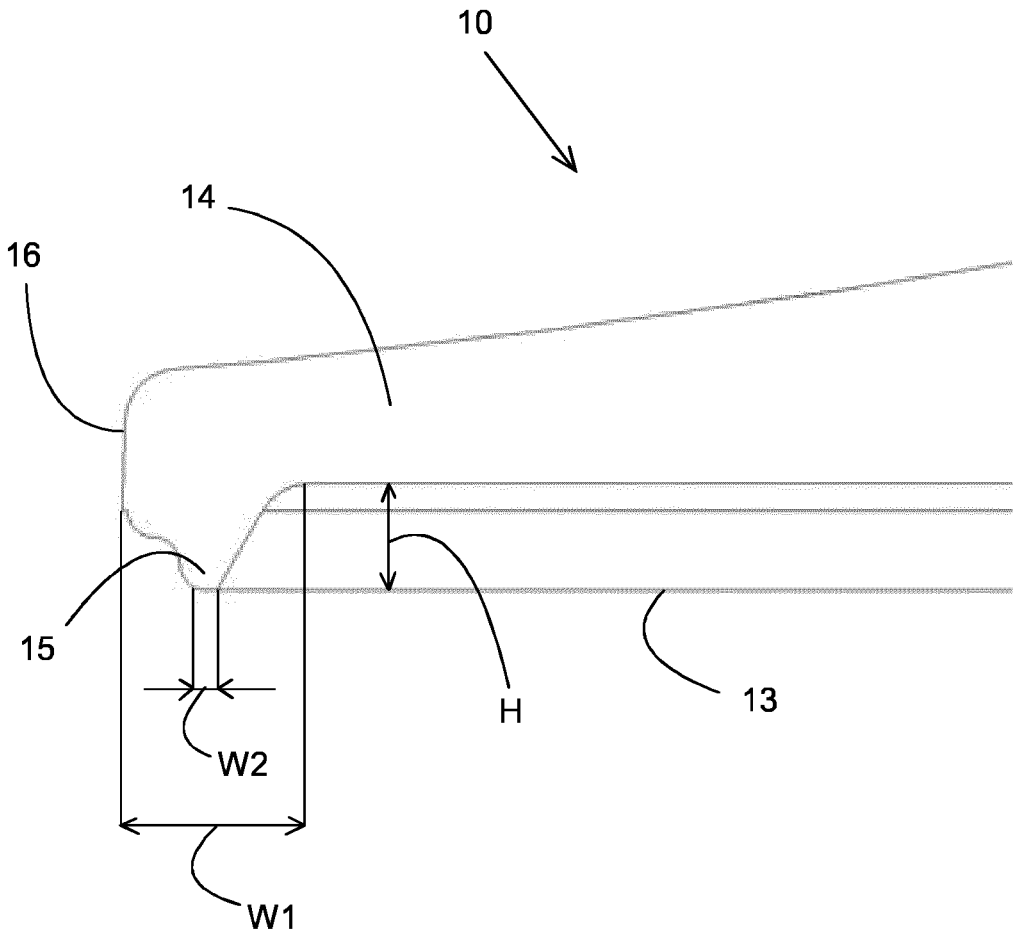
FIG. 7 is a further enlarged cross section of the rotary shaver as shown in FIG. 5.

FIGS. 6 and 7 are enlarged cross sections of the shaver 1 showing the external cutting element 7 with the openings 8 for letting through hairs to be shaved off. The disc-shaped cap 10 as shown in FIGS. 5 and 6 has a disc-shaped covering member 14 being thicker near the axis 12 than near the circumferential edge 16. Due to the rim 15, the distance H between the disc-shaped covering member 11 and the main external surface 13 of the external cutting element 7 is at least 0.1 millimetre. As can best be seen in FIG. 6, the rim 15 has a width W1 near the disc-shaped covering member 14 of for example 0.35 millimetre, whilst the rim 15 has a width W2 near the main external surface 13 of the external cutting element 7 of for example 0.14 millimetre. A disc-shaped cap 10 with such a rim 15 can easily be made out of plastic by injection moulding. Due to the small width W2, crevice corrosion is avoided, whilst due to the difference between the width W1 and W2 a desirable draft is obtained by injection moulding.

It has been found that a continuous uninterrupted (endless) ring-shaped rim 15 with a relatively small width and a minimum height to keep the disc-shaped cap 10 and the external cutting element 7 sufficiently apart, prevents crevice corrosion between the disc-shaped cap 10 and the external cutting element 7.

Figure 8:
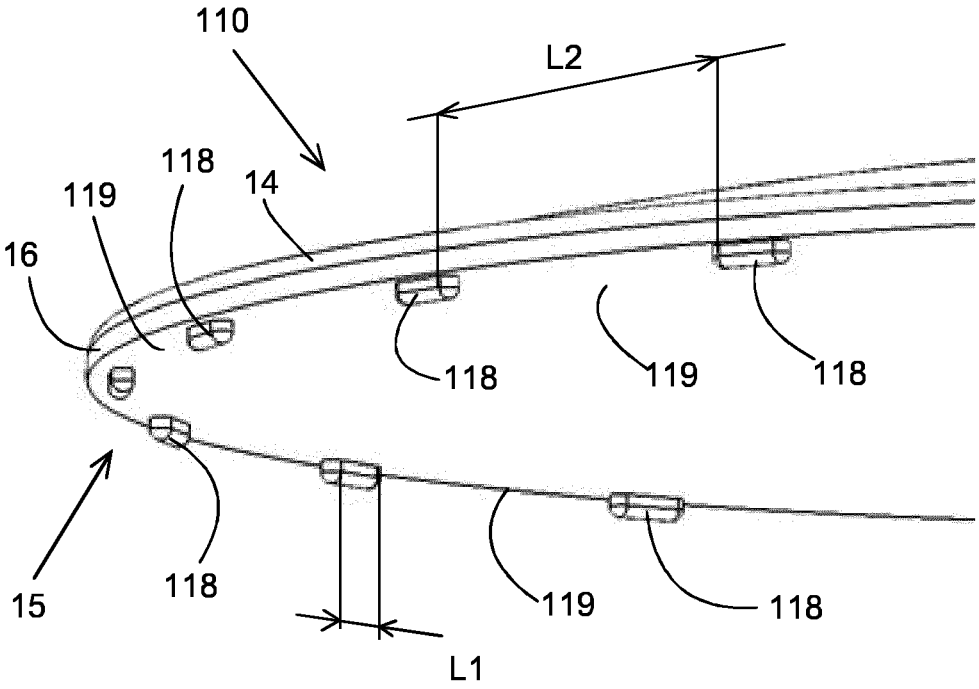
FIG. 8 is a perspective view of a part of a second embodiment of a disc-shaped cap of the rotary shaver as shown in FIG. 1.

FIG. 8 is a perspective view of a second embodiment of a disc-shaped cap 110 of the shaver 1 as shown in FIG. 1. The disc-shaped cap 110 differs from the disc-shaped cap 10 as shown in FIGS. 5 and 6 in that the ring-shaped rim 15 comprises a number of ring-shaped parts 118 with intermediate spaces 119. Each ring-shaped part 118 has the same cross section as the rim 15, and the same widths W1, W2 and height H. Each ring-shaped part 118 has a length L1 in the circumferential direction. Between two adjacent ring-shaped parts 118, the intermediate space 119 has a length L2 in the circumferential direction. In practice, optimized lengths L1, L2 can be determined, as a result of which no or nearly no crevice corrosion will occur and rim 15 provides for good support of the disc-shaped cap 110 on the external cutting element 7.

In the case that the main external surface 13 of the external cutting element 7 and/or the surface of the disc-shaped covering member 14 directed towards the main external surface 13 of the external cutting element 7 are curved, the height H of the rim 15 should be at least such that the gap height of the gap 20 between the main external surface 13 of the external cutting element 7 and the surface of the disc-shaped covering member 14 directed towards the main external surface 13 of the external cutting element 7 is larger than 0.1 millimetre.

Figure 9:
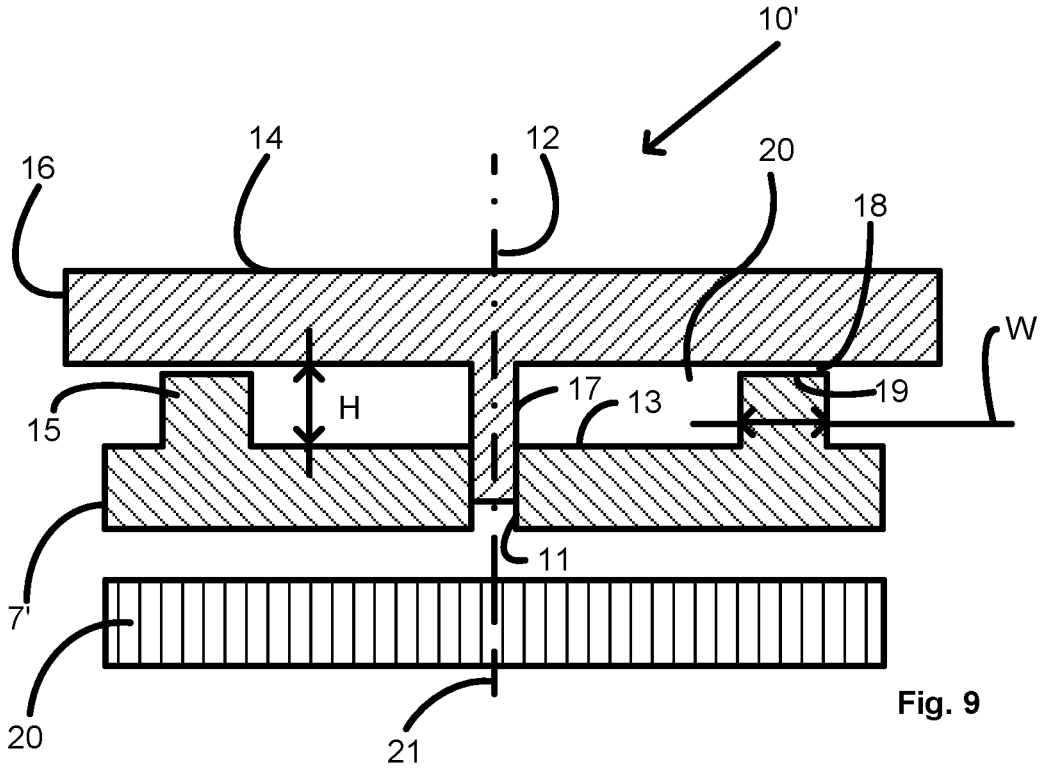
FIG. 9 is schematic cross section of a modification of the rotary shaver as shown in FIG. 1

It is also possible that the ring-shaped rim forms part of the metal external cutting element 7 (FIG. 3) instead of being part of the plastic disc shaped cap 10 (FIG. 3), such as, for example, ring-shaped rim 15 forming part of a metal external cutting element 7' as opposed to a disc-shaped cap 10' as shown a FIG. 9.

It is also possible that the disc-shaped element is made of metal, like aluminium or steel, so that both the disc-shaped element and the external cutting element are made of metal.

It is also possible that the disc-shaped element and the external cutting element are connected to each other at the ring-shaped rim by glue, in which case there is no need for a press-fit connection.

The person skilled in the art will realize that the present invention is by no means limited to the preferred embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

LIST OF REFERENCE SIGNS

1 shaver
2 main housing
3 hair-cutting module
4 central shaft member
5 top portion
6 cutting unit
7 external cutting element
8 opening
9 base portion
10 disc-shaped cap
11 cylindrical passage
12 central axis
13 external surface
14 disc-shaped covering member
15 ring-shaped rim
16 circumferential edge
17 pen

18 gap
19 external surface
20 gap
110 disc-shaped cap
118 ring-shaped part
119 intermediate space
H height
L1 length
L2 length
W width
W1 width
W2 width

The invention claimed is:

1. A rotary shaver comprising:
a metal external cutting element;
an internal cutting element being rotatable with respect to the external cutting element about an axis of rotation;
a disc-shaped element having a central axis extending coaxially with the axis of rotation,
wherein the disc-shaped element covers at least part of the external cutting element; and
a raised ring-shaped rim perpendicularly extending between a side surface of the external cutting element facing the disc-shaped element and a side surface of the disc-shaped element facing the external cutting element,
wherein the ring-shaped rim forms part of one of the external cutting element or the disc-shaped element, and
wherein the raised ring-shaped rim limits crevice corrosion within a gap defined by a portion of the side surface of the disc-shaped element and a portion of the side surface of the external cutting element between the raised ring-shaped rim and the central axis of the disc-shaped element by means of the raised ring-shaped rim having a height (H) of at least 0.1 millimetre in a direction parallel to the central axis and a width (W) of less than 0.35 millimetre in a direction radial to the central axis.

2. A rotary shaver according to claim 1, wherein the ring-shaped rim is a continuous uninterrupted rim.

3. A rotary shaver according to claim 1,
wherein the disc-shaped element comprises a disc-shaped covering member, and
wherein the ring-shaped rim extends along a circumference of the disc-shaped covering member on a side surface of the disc-shaped covering member facing the external cutting element.

4. A rotary shaver according to claim 1, wherein the ring-shaped rim forms part of the external cutting element.

5. A rotary shaver according to claim 1, wherein the ring-shaped rim encloses the gap which is present between the external cutting element and the disc-shaped element and which has a gap height equal to or greater than the height (H) of the ring-shaped rim.

6. A rotary shaver according to claim 1, wherein the disc-shaped element is made of plastic.

7. A rotary shaver according to claim 1, wherein the disc-shaped element and the external cutting element are connected to each other by means of a glue provided on the ring-shaped rim.

8. A rotary shaver according to claim 1, wherein the external cutting element is provided with a passage, whilst the disc-shaped element is provided with a pen having a length, wherein the pen is press-fitted in the passage, and wherein between a wall of the passage and the pen at least one vent extends at least along the length of the pen.

9. A rotary shaver according to claim 1, wherein the external cutting element is provided with a passage, whilst the disc-shaped element is provided with a pen having a length, wherein the pen is press-fitted in the passage, and wherein the ring-shaped rim is spaced from and encircles the pen.

10. A rotary shaver comprising:
a metal external cutting element;
an internal cutting element being rotatable with respect to the external cutting element about an axis of rotation;
a disc-shaped element having a central axis extending coaxially with the axis of rotation,
wherein the disc-shaped element covers at least part of the external cutting element,
wherein the disc-shaped element includes a ring-shaped rim perpendicularly extending along a circumferential edge of a side surface of the disc-shaped element facing a side surface of the external cutting element,
wherein the raised ring-shaped rim limits crevice corrosion within a gap defined by a portion of the side surface of the disc-shaped element and a portion of the side surface of the external cutting element between the raised ring-shaped rim and the central axis of the disc-shaped element by means of the raised ring-shaped rim having a height (H) of at least 0.1 millimetre in a direction parallel to the central axis and a width (W) of less than 0.35 millimetre in a direction radial to the central axis.

11. A rotary shaver according to claim 10, wherein the ring-shaped rim is a continuous uninterrupted rim.

12. A rotary shaver according to claim 10, wherein the ring-shaped rim encloses the gap which is present between the external cutting element and the disc-shaped element and which has a gap height equal to or greater than the height (H) of the ring-shaped rim.

13. A rotary shaver according to claim 10, wherein the external cutting element is provided with a passage, whilst the disc-shaped element is provided with a pen having a length, wherein the pen is press-fitted in the passage, and wherein between a wall of the passage and the pen at least one vent extends at least along the length of the pen.

14. A rotary shaver according to claim 10, wherein the external cutting element is provided with a passage, whilst the disc-shaped element is provided with a pen having a length, wherein the pen is press-fitted in the passage, and wherein the ring-shaped rim is spaced from and encircles the pen.

* * * * *